US010712765B2

(12) United States Patent
Burchard et al.

(10) Patent No.: US 10,712,765 B2
(45) **Date of Patent: *Jul. 14, 2020**

(54) INPUT ASSEMBLY FOR INPUTTING A CONTROL COMMAND AND OPERATOR CONTROL APPARATUS HAVING SUCH AN INPUT ASSEMBLY

(71) Applicant: NBB Holding AG, Oelbronn-Duerrn (DE)

(72) Inventors: Thomas Burchard, Pforzheim (DE); Hans-Peter Bauer, Eisingen (DE)

(73) Assignee: NBB Holding AG, Oelbronn-Duerrn (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/288,431

(22) Filed: Feb. 28, 2019

(65) Prior Publication Data

US 2019/0258285 A1 Aug. 22, 2019

Related U.S. Application Data

(63) Continuation of application No. PCT/EP2017/070092, filed on Aug. 8, 2017.

(30) Foreign Application Priority Data

Sep. 9, 2016 (DE) ..... 10 2016 117 022

(51) Int. Cl.
*G05G 1/02* (2006.01)
*G05G 1/10* (2006.01)
(Continued)

(52) U.S. Cl.
CPC ..... *G05G 5/065* (2013.01); *G05G 1/02* (2013.01); *G05G 1/10* (2013.01); *G05G 13/00* (2013.01); *G05G 2505/00* (2013.01)

(58) Field of Classification Search
CPC .. H01H 13/562; H01H 13/64; H01H 2217/02; H01H 2225/018; H01H 2003/24;
(Continued)

(56) References Cited

U.S. PATENT DOCUMENTS 3,718,786 A 2/1973 Fila
3,743,806 A * 7/1973 Fuller ..... H01H 13/14 200/345
(Continued)

FOREIGN PATENT DOCUMENTS

DE 224392 3/1909
DE 828875 12/1951
(Continued)

OTHER PUBLICATIONS

Signal—Definition of Signal by Merriam-Webster, Jul. 14, 2019 (Year: 2019).*
(Continued)

*Primary Examiner* — Vinh Luong
(74) *Attorney, Agent, or Firm* — Lipsitz & McAllister, LLC

(57) ABSTRACT

An input assembly for inputting a control command for an operator control apparatus is provided, comprising a pushbutton head manually displaceable along a longitudinal axis and a movable signal transmitter which is coupled to the pushbutton head via a coupling mechanism. The input assembly comprises at least one latch element having a latch head which has associated therewith at least one latch depression which the latch head enters when the pushbutton head has reached a predetermined stroke position. The at least one latch element has associated therewith a travel groove oriented parallel to the longitudinal axis, which travel groove the latch head of the latch element enters permanently. The at least one latch depression associated
(Continued)

with the latch element is arranged in the travel groove. An operator control apparatus having such an input assembly is also provided.

23 Claims, 6 Drawing Sheets

(51) Int. Cl.
*G05G 5/06* (2006.01)
*G05G 13/00* (2006.01)

(58) Field of Classification Search
CPC ..... H01H 3/022; H01H 13/585; G05G 2009/04744
See application file for complete search history.

(56) References Cited

U.S. PATENT DOCUMENTS

| | | | | |
|---|---|---|---|---|
| 4,298,778 | A * | 11/1981 | Beresford-Jones | H01H 13/06 200/302.2 |
| 4,317,392 | A * | 3/1982 | Stephens | B25B 23/0035 81/177.85 |
| 4,322,711 | A | 3/1982 | Spangler et al. | |
| 4,758,692 | A * | 7/1988 | Roeser | G01L 5/223 200/6 A |
| 5,041,705 | A | 8/1991 | Piccoli | |
| 5,345,050 | A * | 9/1994 | Branch | H01H 3/022 200/329 |
| 5,665,947 | A | 9/1997 | Falcon | |
| 5,907,138 | A * | 5/1999 | Metzler | H01H 13/64 200/1 B |
| 6,501,458 | B2 | 12/2002 | Baker et al. | |
| 7,030,331 | B2 | 4/2006 | Sasaki | |
| 8,207,805 | B2 | 6/2012 | Wild et al. | |
| 2005/0034966 | A1* | 2/2005 | Krebs | H01H 13/64 200/341 |
| 2008/0165025 | A1 | 7/2008 | Morath | |
| 2011/0240447 | A1 | 10/2011 | Krebs et al. | |
| 2019/0258286 | A1* | 8/2019 | Burchard | G05G 1/02 |

FOREIGN PATENT DOCUMENTS

| | | | |
|---|---|---|---|
| DE | 1165369 | | 5/1960 |
| DE | 1277982 | | 7/1966 |
| DE | 1924042 | | 2/1970 |
| DE | 2216634 | | 10/1973 |
| DE | 2853810 | | 12/1978 |
| DE | 3608569 | A1 * | 9/1987 |
| DE | 9407052 | | 8/1994 |
| DE | 4330502 | | 10/1994 |
| DE | 4412557 | A1 * | 10/1995 |
| DE | 19842806 | | 4/1999 |
| DE | 10304595 | | 10/2004 |
| DE | 10319180 | | 11/2004 |
| DE | 60104488 | | 12/2004 |
| DE | 10331130 | | 2/2005 |
| DE | 102004053033 | | 12/2005 |
| DE | 202006017729 | | 5/2008 |
| DE | 102006059822 | | 6/2008 |
| DE | 102007046512 | | 4/2009 |
| DE | 102008057993 | | 1/2010 |
| DE | 102010006826 | | 8/2011 |
| DE | 102012023806 | | 6/2014 |
| DE | 102014111715 | | 2/2016 |
| EP | 0365377 | | 4/1990 |
| EP | 2803888 | | 11/2014 |
| FR | 2604559 | | 4/1988 |
| GB | 1241548 | | 8/1971 |
| GB | 2001124 | B * | 5/1982 |

OTHER PUBLICATIONS

Derwent English Abstract of DE 3608569 A1, Gorner et al., Sep. 17, 1987.*

* cited by examiner

INPUT ASSEMBLY FOR INPUTTING A CONTROL COMMAND AND OPERATOR CONTROL APPARATUS HAVING SUCH AN INPUT ASSEMBLY

This application is a continuation of international application number PCT/EP2017/070092 filed on Aug. 8, 2017 and claims the benefit of German application number 10 2016 117 022.4 filed on Sep. 9, 2016, which are incorporated herein by reference in their entirety and for all purposes.

BACKGROUND OF THE INVENTION

The invention relates to an input assembly for inputting a control command for an operator control apparatus, for example for a remote control apparatus, in particular a radio remote control apparatus, comprising a pushbutton head manually displaceable along a longitudinal axis and a movable signal transmitter which is coupled to the pushbutton head via a coupling mechanism, wherein the input assembly comprises at least one latch element having a latch head which has associated therewith at least one latch depression which the latch head enters when the pushbutton head has reached a predetermined stroke position.

The invention further relates to an operator control apparatus, in particular a remote control apparatus, for example a radio remote control apparatus, comprising at least one input assembly of the kind mentioned above.

Such operator control apparatuses are also referred to as manually actuatable control apparatuses and can be configured, for example, in the form of remote control apparatuses, in particular radio remote control apparatuses. They can be used, for example, in forestry and construction technology, in particular for controlling cranes and hoisting devices.

Operator control apparatuses of the kind mentioned at the outset enable a user to manually input a control command which can then be transmitted via a transmission channel to a technical device that is to be controlled. Transmission can take place via a remote control line, in particular via a remote control wire, or also wirelessly, for example over an infrared link or a radio link.

For the input of control commands, the input assemblies have a pushbutton head that can be manually displaced along a longitudinal axis. The pushbutton head is coupled via a coupling mechanism to a signal transmitter that can be moved. The signal transmitter can generate a signal that depends on the stroke position of the pushbutton head and which corresponds to a certain control command.

Such input assemblies and operator control apparatuses, being in the form of remote control apparatuses in particular, are often used in harsh environments wherein the user actuates the pushbutton head with gloves on. Here, it is helpful for the user to be provided with tactile feedback when one or more stroke positions of the pushbutton head have been reached, as this facilitates the handling of the input assembly and therefore the handling of the operator control apparatus. To this end, the input assembly comprises at least one latch element having a latch head which has associated therewith at least one latch depression which the latch head enters when the pushbutton head has reached a predetermined stroke position. The entry of the latch head in the latch depression gives the user tactile feedback based on which he or she can be aware that the pushbutton head has reached a certain stroke position and, therefore, a signal corresponding to the particular stroke position has been generated by the signal transmitter.

In known input assemblies, the at least one latch head and/or the at least one latch depression which is associated with the latch head is subject to considerable wear, thereby limiting the lifetime of the input assembly.

It is an object of the present invention to improve an input assembly and an operator control apparatus of the generic kind in such a manner that they have a prolonged lifetime.

SUMMARY OF THE INVENTION

This object is accomplished, in accordance with the invention, in an input assembly of the generic kind in that the at least one latch element has associated therewith a travel groove oriented parallel to the longitudinal axis of the input assembly, which travel groove the latch head of the latch element enters permanently, wherein the at least one latch depression associated with the latch element is arranged in the travel groove.

The concept is incorporated in the invention that the wear on the latch head and on the latch depression associated therewith can be reduced by arranging the latch depression in a travel groove which is oriented parallel to the longitudinal axis of the input assembly and which the latch head enters permanently. Upon actuation of the pushbutton head, the at least one latch head is moved along the travel groove and the latch head enters a latch depression arranged in the travel groove when a predetermined stroke position is reached.

It is advantageous for the shape of the latch depression to be adapted to the shape of the latch head. This provides a way for the contact of the latch head against the latch depression to be not only a point contact but a line or area contact. Wear on the latch depression and on the latch head can thereby be kept particularly low.

Further reduction in wear can be also be achieved by the shape of the travel groove being adapted to the shape of the latch head.

Preferably, the travel groove has arranged therein a plurality of latch depressions positioned in a series one after the other with respect to the longitudinal axis of the input assembly, which latch depressions the latch head enters successively in a movement of the pushbutton head. As the pushbutton head is moved along the longitudinal axis by the user, when predetermined stroke positions are reached, the latch head in each case enters a latch depression and thereby gives to the user tactile feedback on reaching the respective stroke position.

It is advantageous for the latch head to be of ball-shaped configuration and for the travel groove to have, relative to the longitudinal axis of the input assembly, a concave, circular arc shaped surface contour in a circumferential direction and, in an axial direction, an undulating surface contour comprising ridges and depressions which succeed each other in the axial direction and along which the latch head slides in preferably line contact therewith when the pushbutton head is displaced and thereby provides to the user tactile feedback on reaching predetermined stroke positions when the pushbutton head is actuated. The depressions of the travel groove form a latch depression in each case.

In an advantageous embodiment of the invention, the input assembly comprises a latch member which is rigidly connected to the pushbutton head and which comprises at least one travel groove which is associated with a latch element and has at least one latch depression. The latch member can be moved together with the pushbutton head in an axial direction. It can comprise one or also more travel grooves, each of which is associated with a latch element held for non-displacement in an axial direction, the latch head of which latch element enters the respective associated travel groove permanently, independently of the stroke position of the pushbutton head.

Provision may be made for the latch member to be configured as a latch sleeve whose longitudinal axis is oriented coaxially with respect to the longitudinal axis of the input assembly and which carries on its exterior at least one travel groove having at least one latch depression. The latch sleeve is rigidly connected to a plunger which is itself rigidly connected to the pushbutton head. Actuating the pushbutton head leads to a linear movement of the plunger and the latch sleeve and when at least one predetermined stroke position of the pushbutton head is reached, a latch head enters a latch depression of the travel groove arranged on the exterior of the latch sleeve.

Advantageously, the input assembly comprises at least two latch elements in diametrically opposed relation to each other, which latch elements are aligned in line with each other and whose latch heads are biased radially in a direction towards the longitudinal axis of the input assembly by way of return springs. The two latch heads can receive between them a latch member rigidly connected to the pushbutton head, which latch member has on its exterior two travel grooves into each of which enters a latch head.

An advantageous configuration of an input assembly in accordance with the invention comprises a rotary member rotatable about an axis of rotation, to which rotary member the signal transmitter is held in a rotationally fixed manner, wherein the pushbutton head is coupled to the rotary member via the coupling mechanism and a linear movement of the pushbutton head is translatable by the coupling mechanism into a rotary movement of the rotary member. The signal transmitter held to the rotary member in a rotationally fixed manner can interact with a sensor element of the operator control apparatus. By actuation of the pushbutton head, the rotary member and therefore the signal transmitter can be caused to rotate and the rotary position and/or rotary position change of the signal transmitter can be detected by way of the sensor element. It is thereby rendered possible for the user to input control commands that depend on the movement of the pushbutton head.

Advantageously, the axis of rotation of the rotary member is oriented coaxially with respect to the longitudinal axis of the input assembly.

In an advantageous configuration of the input assembly in accordance with the invention, the signal transmitter is configured as a permanent magnet. By actuation of the pushbutton head, the rotary position of the permanent magnet arranged on the rotary member can be changed, and this in turn has as a consequence that the direction of the magnetic field generated by the permanent magnet changes. The change in direction can be detected by a magnetic field sensitive sensor element associated with the signal transmitter, which sensor element can then provide a corresponding sensor signal to the control and transmission electronics of the operator control apparatus.

Preferably, the permanent magnet is magnetised in a direction transverse to the longitudinal axis of the input assembly.

In an advantageous configuration, the input assembly comprises a support part to which the rotary member is held for non-movement in an axial direction and for rotational movement about the axis of rotation. By way of example, the support part can comprise a guide sleeve to which the rotary member is held in axially non-movable and rotatable relation therewith.

As has already been mentioned, a linear movement of the pushbutton head can be translated via a coupling mechanism into a rotary movement of the rotary member. To this end, in an advantageous embodiment of the invention, the coupling mechanism comprises a plunger held to the pushbutton head, which plunger is coupled to the rotary member via a driver and a guide slot, wherein the driver enters the guide slot and wherein the guide slot, relative to the longitudinal axis of the input assembly, extends in the shape of a curve in an axial direction and in a circumferential direction. The plunger is connected to the pushbutton head and can be moved along the longitudinal axis together with the pushbutton head. The linear movement of the plunger is translated into a rotary movement of the rotary member via the driver and the guide slot which the driver enters.

The guide slot is configured in the shape of a curve in the manner of a helix and extends in both an axial direction and a circumferential direction. The driver and the guide slot thus form a control guide track which translates a linear movement into a rotary movement.

It is advantageous for the driver to be held to the plunger in a rotationally fixed manner and for the guide slot to be arranged on the rotary member.

By way of example, provision may be made for the driver to be configured in the form of a pin and to have at least one end thereof projecting radially from the plunger, wherein the projecting end thereof enters a guide slot of the rotary member.

It is advantageous for the driver to be configured as a driver pin which extends diametrically through the plunger and engages at each of its two ends in a guide slot of the rotary member.

Preferably, the input assembly in accordance with the invention allows for stepless command input by the position of the signal transmitter changing continuously depending on the extent of the stroke movement of the pushbutton head. As has been mentioned, provision may be made, for example, for the signal transmitter to be fixed to a rotary member whose rotary position changes continuously depending on the stroke movement of the pushbutton head.

It is advantageous for the input assembly to comprise an elastically deformable cover part. The cover part can be configured in the form of a bellows, for example.

It is advantageous for the cover part to be formed from an elastically deformable plastics material.

In an advantageous configuration of the input assembly in accordance with the invention, the elastically deformable cover part engages underneath the pushbutton head which can be manually actuated by the user.

It is particularly advantageous for the pushbutton head to be connected to the cover part in a splashproof manner.

Preferably, the input assembly forms a preassemblable constructional unit. This facilitates mounting of the input assembly on the operator control apparatus. By way of example, provision may be made for the preassembled constructional unit to be insertable into a recess of the operator control apparatus.

As mentioned at the outset, the invention also refers to an operator control apparatus, in particular to a remote control apparatus, for example a radio remote control apparatus. In accordance with the invention, the operator control apparatus comprises a splashproof housing and at least one input assembly of the kind described above, wherein the signal transmitter of the input assembly interacts with a sensor element which is arranged in the housing. In addition, the operator control apparatus can comprise control and transmission electronics which are in communication with the sensor element and which generate, on the basis of the sensor signal provided by the sensor element, a control signal which can be transmitted to a device that is to be controlled, for example a crane or a hoisting device. Transmission can be realized via a remote control wire, or it may be provided for the transmission to be wireless, for example an infrared or a radio link.

In an advantageous embodiment of the operator control apparatus in accordance with the invention, particularly simple mounting is achieved by the housing of the operator control apparatus comprising at least one exterior recess which receives an input assembly, wherein the input assembly can be inserted into the exterior recess in the form of a preassembled constructional unit and removed from the recess when required. This facilitates not only the mounting of the input assembly on the operator control apparatus but also the replacement of the input assembly, as the input assembly can be mounted without opening the splashproof housing of the operator control apparatus. In particular, replacement can be realized without risking damage to a seal of the housing.

As has already been mentioned, in an advantageous embodiment of the operator control apparatus, the rotary position and/or rotary position change of the signal transmitter of the input assembly can be detected by the associated sensor element of the operator control apparatus so that the sensor element can provide to the control and transmission electronics a sensor signal that depends on the rotary position and/or rotary position change of the signal transmitter.

The signal transmitter and the sensor element can interact in a contact-based manner. Thus, by way of example, provision may be made for the sensor element arranged in the housing of the operator control apparatus to be configured as a rotary potentiometer and for the signal transmitter arranged on a rotary member to be configured in the form of a driver which is in engagement with the rotary potentiometer.

It is particularly advantageous for the signal transmitter and the sensor element to interact in a contactless manner because this can prevent mechanical interference of the associated sensor element by the signal transmitter and, therefore, the occurrence of premature wear. The non-contact interaction between signal transmitter and sensor element is also advantageous in that the sensor element can detect the rotary position and/or the rotary position change of the signal transmitter even if a wall section of the housing of the operator control apparatus is arranged between the signal transmitter and the sensor element. The wall section can preferably be made of a plastics material that practically does not interfere with the detection of the rotary position and/or rotary position change by the sensor element. Non-contact interaction of the signal transmitter and the sensor element therefore allows the exterior recess of the housing which receives the input assembly to be formed without the use of through-holes. Therefore, the signal transmitter, like the remaining constituent components of the input assembly, can be arranged completely on the exterior of the housing and need not, for instance, protrude into the interior of the housing. This facilitates mounting and replacement of the input assembly.

The signal transmitter can be configured as a permanent magnet and the sensor element interacting with the signal transmitter is preferably sensitive to magnetic fields.

Preferably, the operator control apparatus comprises at least one connecting element which can be placed upon an input assembly and can be releasably connected to the housing. The input assembly can be fixed to the housing of the operator control apparatus by way of the connecting element.

In particular, provision may be made for the connecting element to be screwably connectable to the housing.

The input assembly can be inserted into an exterior recess of the housing, and the connecting element can be placed onto the input assembly and releasably connected to the housing so that the input assembly is fixed in the recess of the housing.

It is advantageous for the connecting element to engage, relative to a mounting direction, behind an input assembly inserted in an exterior recess of the housing.

In an advantageous embodiment of the operator control apparatus in accordance with the invention, the connecting element is configured in the manner of a union ring which is screwably connectable to the housing.

Preferably, the exterior recess of the housing has a support surface and the input assembly comprises a support part which is supported on the support surface, preferably with a sealing element, for example a sealing ring, interposed therebetween. When the input assembly is inserted into the exterior recess, the support part can rest on the support surface so that forces acting on the support part in a mounting direction can be accommodated by the support surface.

By way of example, the support surface can form a narrowing of the recess of the housing, in particular a step, via which the diameter of the recess is reduced.

Where a rotary member is used to which the signal transmitter is held in a rotationally fixed manner, it is advantageous for the rotary member to assume a distance from the housing so that the rotary movement of the rotary member and the signal transmitter is not interfered with by the housing.

The following description of an advantageous embodiment of an input assembly in accordance with the invention and an advantageous embodiment of an operator control apparatus in accordance with the invention, taken in conjunction with the drawings, serves to explain the invention in greater detail.

DETAILED DESCRIPTION OF THE INVENTION

Figure 1:
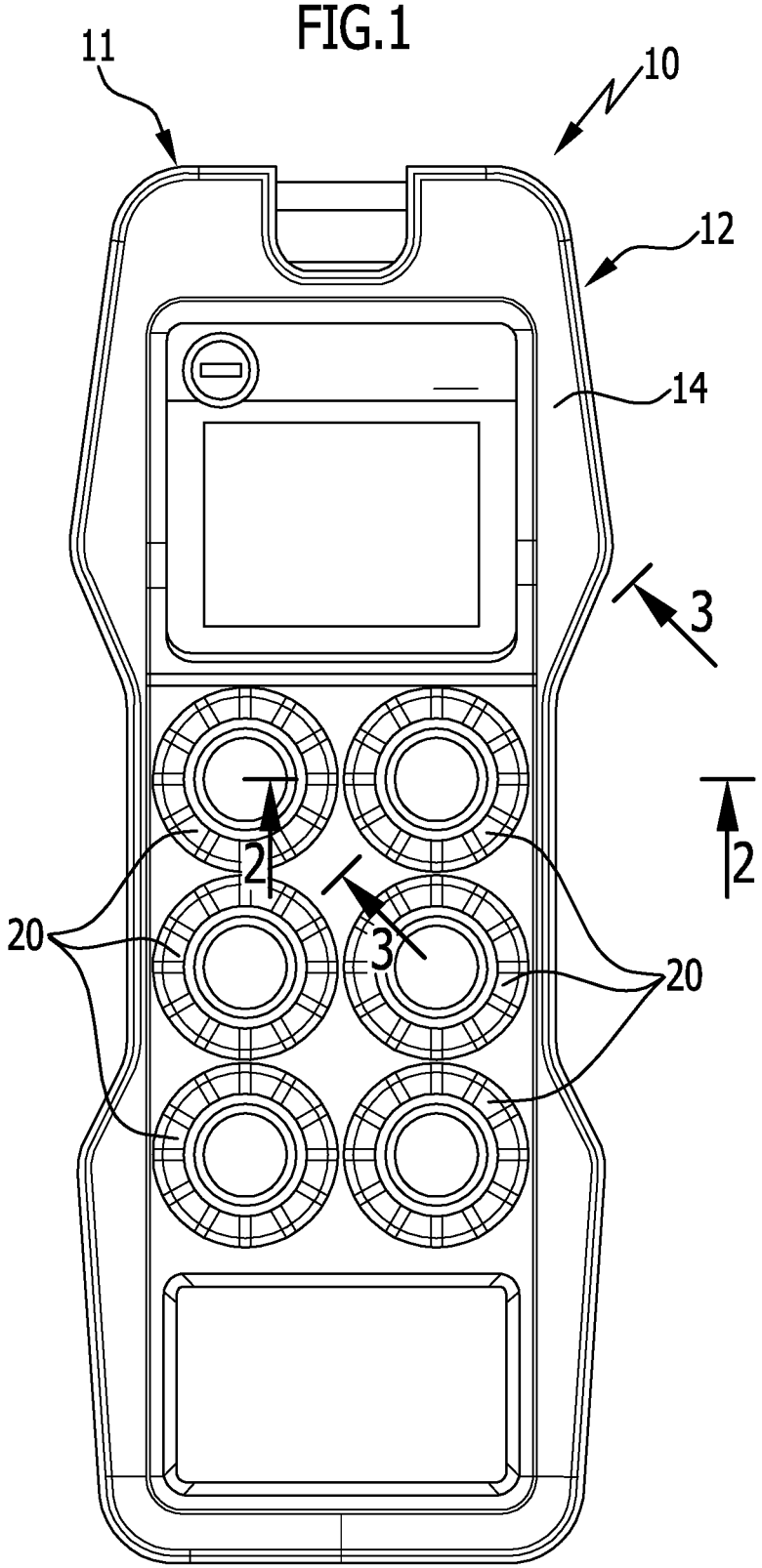
FIG. 1 is a top view illustrating an operator control apparatus in the form of a radio remote control apparatus having a plurality of input assemblies.
Figure 2:
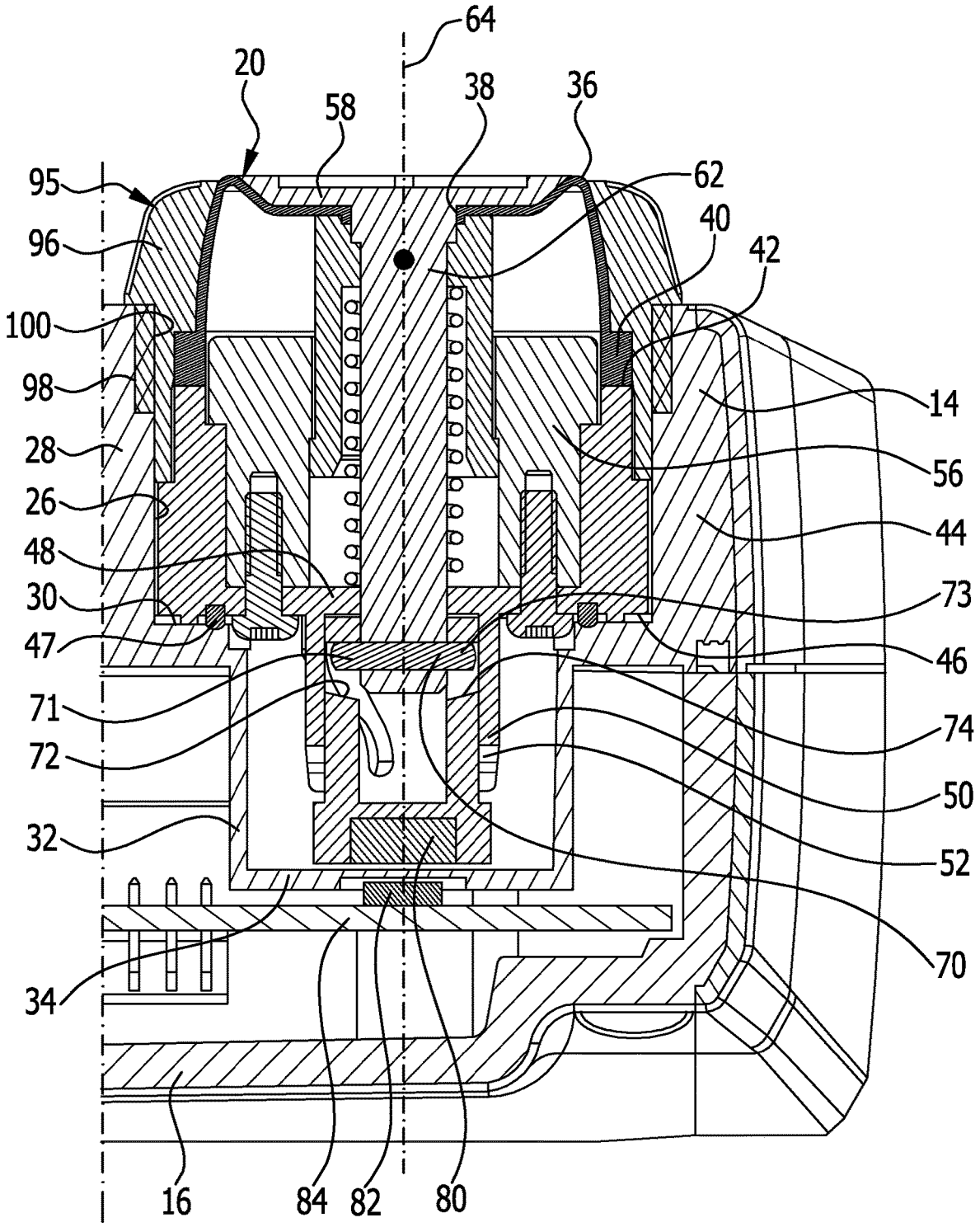
FIG. 2 shows an input assembly in a sectional view taken along line 2-2 of FIG. 1.
Figure 3:
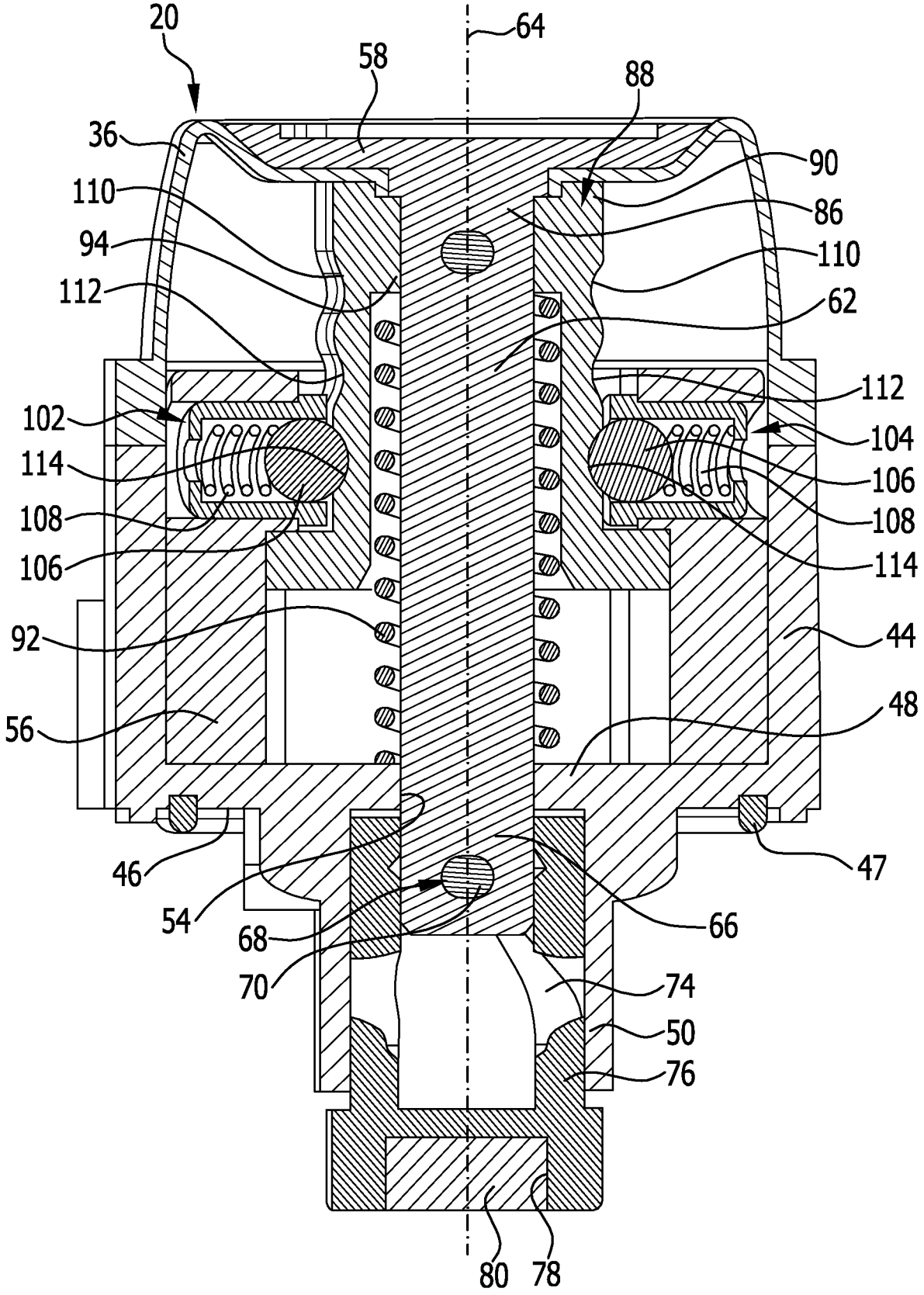
FIG. 3 shows the input assembly of FIG. 2 in a sectional view taken along line 3-3 of FIG. 1.
Figure 4:
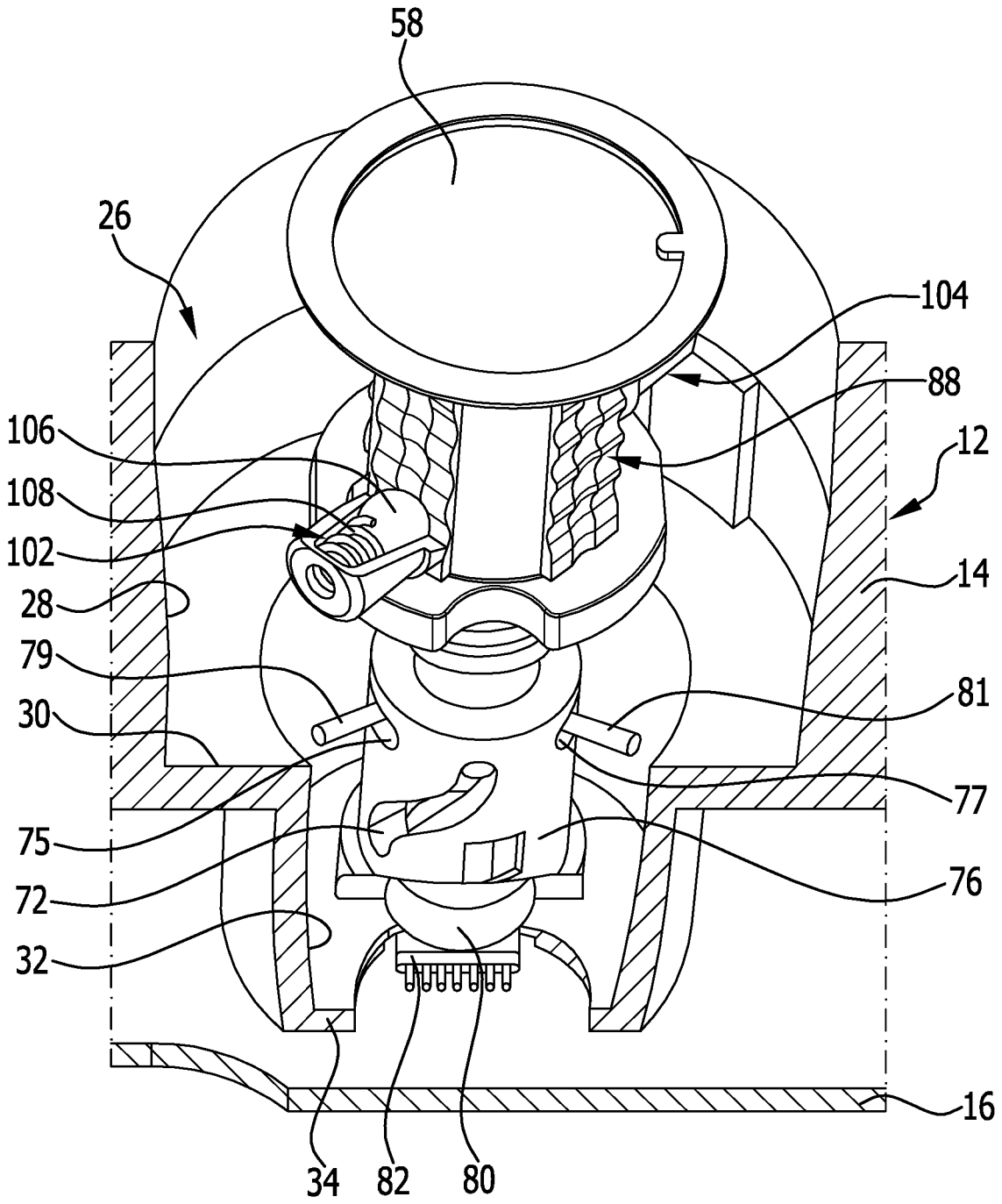
FIG. 4 is a perspective partial view of the input assembly of FIGS. 2 and 3.

The drawing shows a schematic representation of an advantageous embodiment of an operator control apparatus in accordance with the invention, generally designated by the reference numeral 10. The operator control apparatus 10 in the illustrated embodiment forms a radio remote control apparatus 11 and comprises a housing 12 having a housing upper part 14 and a housing lower part 16 which are connected together in a splashproof manner. Received in the housing 12 are control and transmission electronics, known per se and not shown in the drawing in the interest of clarity, for generating and transmitting a control signal to a device that is to be controlled, such as a crane or a hoisting device.

Figure 7:
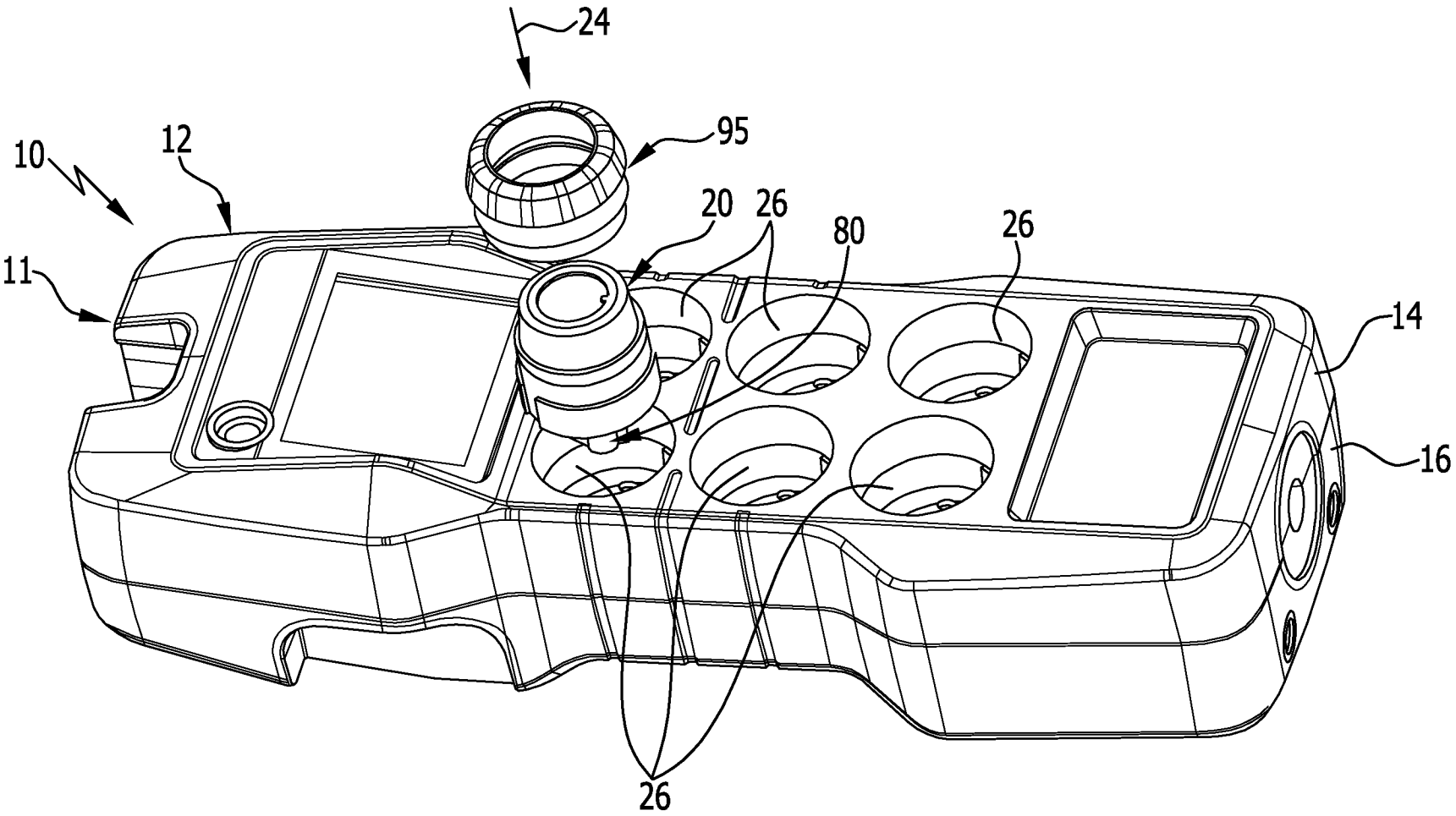
FIG. 7 illustrates an input assembly being mounted to a housing of the operator control apparatus of FIG. 1.

The drawing further shows a schematic representation of an advantageous embodiment of an input assembly in accordance with the invention, generally designated by the reference numeral 20. A plurality of these input assemblies 20, having identical configurations, are arranged on the housing upper part 14, and these can be manually operated by the user for stepless input of control commands. The input assemblies 20 each form a preassemblable constructional unit which can be inserted into an upper-side recess 26 of the housing upper part 14 in a mounting direction shown in FIG. 7 by the arrow 24. The recesses 26 are of circular cylindrical configuration and have a side wall upper section 28 which transitions via a radially inwardly directed step 30 to a side wall lower section 32 which is adjoined by a closed bottom wall 34.

Each input assembly 20 comprises a hood-like, elastically deformable cover part 36 having a central cover opening 38 and a support ring 40. The support ring 40 is supported on an upper side 42 of a sleeve-like support part 44 which, at an underside 46 thereof facing away from the upper side 42, rests on the step 30, with a sealing ring 47 interposed therebetween. At the level of the underside 46, the support part 44 forms an intermediate wall 48 which, in a direction towards the bottom wall 34 of the recess 26, is adjoined by a guide sleeve 50. The guide sleeve 50 is arranged at a distance from the side wall lower section 32 and has its free end 52 assuming a distance from the bottom wall 34.

The intermediate wall 48 has a central wall opening 54 which is aligned in line with the cover opening 38. Supported on the intermediate wall 48 is a holding part 56 which is screwed together with the intermediate wall 48. The holding part 56 is configured as a hollow cylinder.

For input of a control command, the input assemblies 20 each have a flat pushbutton head 58 which rests on the cover part 36. Adjoining the pushbutton head 58 in rigid relation therewith is a plunger 62 which is oriented coaxially with respect to a longitudinal axis 64 of the input assembly 20 and which, at a lower end section 66 thereof facing towards the bottom wall 34, extends through the central wall opening 54 of the intermediate wall 48. Arranged at the lower end section 66 of the plunger 62 is a driver 68 which is configured in the form of a driver pin 70 oriented perpendicularly to the longitudinal axis 64 and which extends diametrically through the lower end section 66. The end portions 71, 73 of the driver pin 70 protruding in a radial direction from the lower end section 66 in each case enter a curve-shaped guide slot 72, 74 of a sleeve-like rotary member 76 which extends from the intermediate wall 48 in a direction towards the bottom wall.

The rotary member 76 is axially non-movably held to the guide sleeve 50 in relation to the longitudinal axis 64. To this end, the rotary member 76 has two holding slots 75, 77 in axially and circumferentially offset relation to the guide slots 72, 74, which holding slots 75, 77 extend in a circumferential direction with respect to the longitudinal axis 64 and into each of which enters a holding pin 79, 81 held to the guide sleeve 50 in stationary relation therewith.

On a side facing towards the bottom wall 34, the rotary member 76 has a circular cylindrical receptacle 78 in which a cylindrical permanent magnet 80 polarised laterally, i.e. transversely to the longitudinal axis 64, is held in a rotationally fixed manner. The permanent magnet forms a signal transmitter. Associated with the permanent magnet 80 is a magnetic field sensitive sensor element 82 which is arranged below the bottom wall 34 on a circuit board 84 positioned in the housing 12 and which, via electrical connection lines known per se and therefore not shown in the drawing in the interest of clarity, is in electric communication with the control and transmission electronics, not illustrated in the drawing, of the operator control apparatus 10.

At an upper end section 86 of the plunger 62, a latch member 88 is fixed which, in the exemplary embodiment illustrated, is configured as a cylindrical latch sleeve 90. The latch sleeve 90 has the plunger 62 extending therethrough in a longitudinal direction. The plunger 62 is surrounded by a helical-shaped return spring 92 which is supported on the one hand on a radially inwardly directed collar 94 of the latch sleeve 90 and, on the other, on the intermediate wall 48.

As has already been mentioned, each input assembly 20 forms a preassemblable constructional unit which can be inserted into a recess 26 in the mounting direction 24. A connecting element 95, in the illustrated exemplary embodiment shown as being configured in the form of a union ring 96, is used for fixing the respective input assembly 20 in the recess 26. The union ring 96 surrounds the cover part 36 and the pushbutton head 58 in a circumferential direction and has an external thread 98 which can be screwed into a complementarily configured internal thread 100 which is arranged at the side wall upper section 28 of the recess 26.

For stepless command input, the user can actuate the pushbutton head 58 so that the latter, together with the plunger 62 and the latch sleeve 90, under elastic deformation of the cover part 36, is linearly displaced along the longitudinal axis 64 against the return force of the return spring 92. The linear movement of the plunger 62 is translated via the driver 68 and the curve-shaped guide slots 72, 74 extending in an axial and in a circumferential direction into a rotational movement of the rotary member 76 and the permanent magnet 80 fixed thereto. The axis of rotation of the rotary member 76 coincides with the longitudinal axis 64 of the input assembly 20. Actuating the pushbutton head 58 causes a change in the rotary position of the permanent magnet 80. The permanent magnet 80 is magnetised transversely to the longitudinal axis 64 so that a change in the rotary position of the permanent magnet 80 causes a change in the orientation of the magnetic field created thereby, relative to the longitudinal axis 64. The magnetic field extends through the bottom wall 34 so that its orientation can be detected within the housing 12 by the sensor element 82. The change in rotary position of the permanent magnet 80 caused by the stroke movement of the pushbutton head 58 is thus detected by the magnetic field sensitive sensor element 82, which then provides to the control and transmission electronics a sensor signal that depends on the rotary position of the permanent magnet 80. The control and transmission electronics then generate a corresponding control signal which is transmitted to the device that is to be controlled.

In order to provide the user with tactile feedback on reaching predetermined stroke positions of the pushbutton head 58, the input assemblies 20 each have two latch elements 102, 104 in diametrically opposed relation to each other, which latch elements 102, 104 are held to the holding part 56 and each have a ball-shaped latch head 106 which is biased radially inwardly with respect to the longitudinal axis 64 by way of a latch spring 108. The latch elements 102, 104 are in each case associated with three latch depressions 110, 112, 114 which are arranged in a series one after the other in an axial direction on the exterior of the latch sleeve 90. When the plunger 62 is linearly moved by actuating the pushbutton head 58, the latch heads 106, in certain stroke positions which are predetermined by the location of the latch depressions 110, 112, 114, enter one of the latch depressions 110, 112, 114 and thereby give to the user tactile feedback on reaching the respective stroke position.

Figure 5:
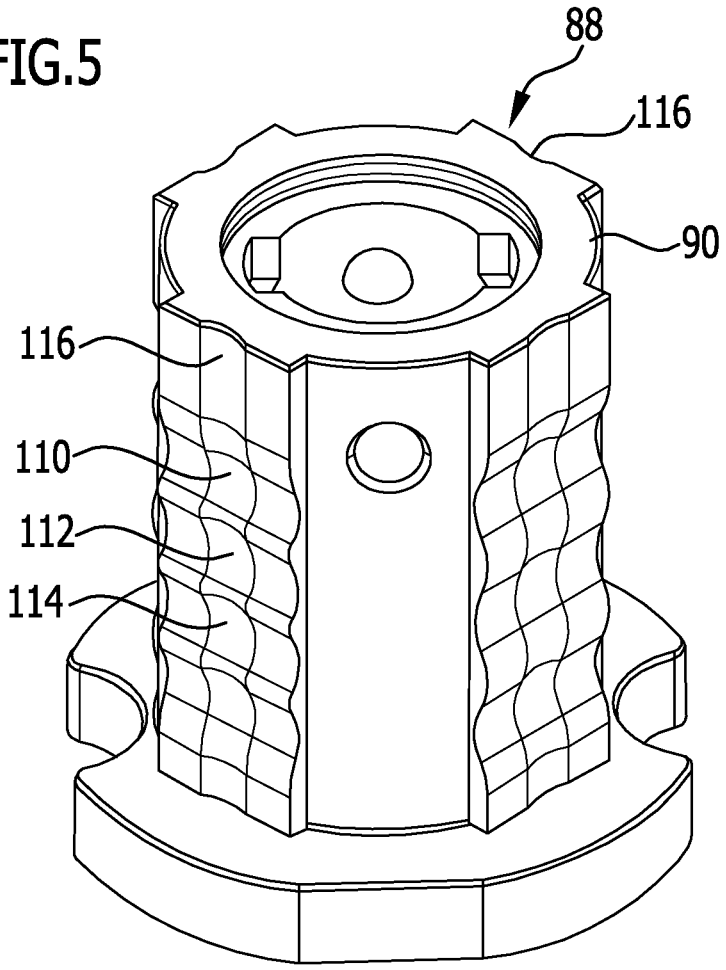
FIG. 5 is a perspective view illustrating a latch member of the input assembly of FIG. 4.
Figure 6:
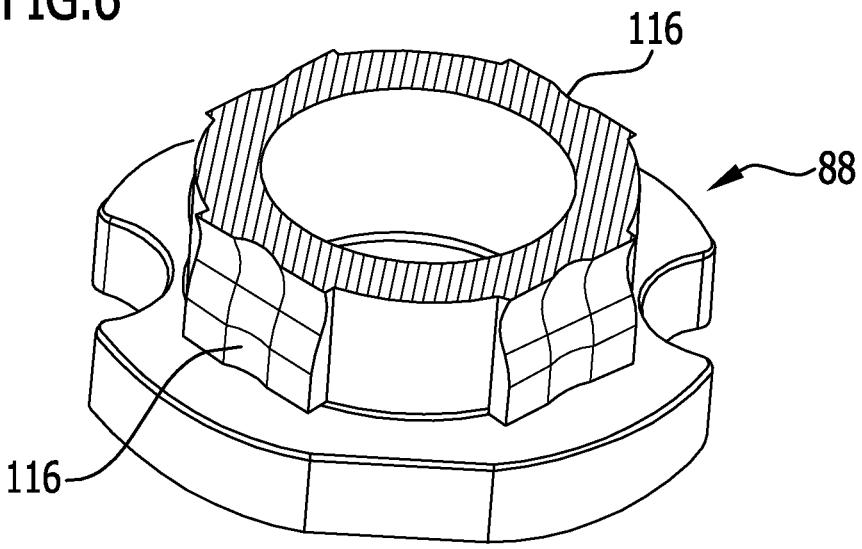
FIG. 6 is a sectional view of the latch member of FIG. 5.

As can be seen in FIGS. 5 and 6 in particular, the latch depressions 110, 112, 114 associated with each of the latch elements 102, 104 are integrally formed in a travel groove 116 which extends in an axial direction along the exterior of the latch sleeve 90. The shape of the travel groove 116, like the shape of the latch depressions 110, 112, 114, is adapted to the ball shape of the respective latch head 106 that enters them. With respect to the longitudinal axis 64 of the input assembly 20, the travel groove 116 has a concave, circular arc shaped surface contour in a circumferential direction and, in an axial direction, an undulating surface contour comprising ridges and depressions which succeed each other in the axial direction and along which the latch head 106 slides in line contact therewith when the pushbutton head 58 is moved and thereby provides to the user tactile feedback on reaching predetermined stroke positions when the pushbutton head 58 is actuated. Adapting the shape of the travel groove 116 and the latch depressions 110, 112, 114 to the shape of the latch head 106 prevents point loading of both the travel groove 116 and the latch depressions 110, 112, 114 caused by the latch head 106.

The input assemblies 20 are very easy to mount. As has already been mentioned, each input assembly 20 can be inserted as a preassembled constructional unit into a recess 26 in the mounting direction 24. A union ring 96 can then be placed onto the input assembly 20 and screwed together with the housing 12. There is therefore no need to open the housing 12 for mounting the input assemblies 20. Should replacement of one or more input assemblies 20 be required at a later time, such replacement can also be realized without the need to open the housing 12. All that is necessary is to release the screwed connection of the union ring 96, and when this is done, the respective input assembly 20 may easily be removed from the recess 26.

What is claimed is:

1. An input assembly for inputting a control command for an operator control apparatus, comprising:

a pushbutton head adapted to be manually displaceable along a longitudinal axis, a movable signal transmitter which is coupled to the pushbutton head via a coupling mechanism, at least one latch element having a latch head which has associated therewith at least one latch depression, the latch head entering the latch depression when the pushbutton head reaches a predetermined stroke position, a travel groove associated with the at least one latch element, the travel groove extending parallel to the longitudinal axis, wherein:

the latch head of the latch element enters the travel groove permanently, the at least one latch depression associated with the latch element is arranged in the travel groove, and the latch head is of ball-shaped configuration and the travel groove has, relative to the longitudinal axis, a concave, circular arc shaped surface contour in a circumferential direction and, in an axial direction, an undulating surface contour comprising ridges and depressions which succeed each other in the axial direction and along which the latch head slides in line contact therewith when the pushbutton head is moved.

2. The input assembly in accordance with claim 1, wherein the input assembly further comprises a latch member which is rigidly connected to the pushbutton head and which comprises the travel groove associated with each of the corresponding at least one latch element and comprises the at least one latch depression.

3. The input assembly in accordance with claim 2, wherein the latch member is configured as a latch sleeve whose longitudinal axis is oriented coaxially with respect to the longitudinal axis of the input assembly and which carries on its exterior the travel groove associated with each of the corresponding at least one latch element.

4. The input assembly in accordance with claim 1, wherein:

the at least one latch element comprises an even number of latch elements in diametrically opposed relation to each other, which latch elements are aligned in line with each other and whose latch heads are biased radially in a direction towards the longitudinal axis of the input assembly by way of return springs.

5. The input assembly in accordance with claim 1, further comprising a rotary member rotatable about an axis of rotation, to which rotary member the signal transmitter is held in a rotationally fixed manner, wherein the pushbutton head is coupled to the rotary member via the coupling mechanism and a linear movement of the pushbutton head is translatable by the coupling mechanism into a rotary movement of the rotary member.

6. The input assembly in accordance with claim 5, wherein the axis of rotation of the rotary member is oriented coaxially with respect to the longitudinal axis of the input assembly.

7. The input assembly in accordance with claim 5, wherein the signal transmitter is configured as a permanent magnet.

8. The input assembly in accordance with claim 7, wherein the permanent magnet is magnetized in a direction transverse to the longitudinal axis of the input assembly.

9. The input assembly in accordance with claim 5, further comprising a support part to which the rotary member is held for non-movement in an axial direction and for rotational movement about the axis of rotation.

10. The input assembly in accordance with claim 5, wherein the coupling mechanism comprises a plunger held to the pushbutton head, which plunger is coupled to the rotary member via a driver and a guide slot, wherein the driver enters the guide slot and wherein the guide slot, relative to the longitudinal axis, extends in the shape of a curve in an axial direction and in a circumferential direction.

11. The input assembly in accordance with claim 10, wherein the driver is held to the plunger in a rotationally fixed manner and the guide slot is arranged on the rotary member.

12. The input assembly in accordance with claim 1, wherein the input assembly comprises an elastically deformable cover part.

13. The input assembly in accordance with claim 1, wherein the input assembly forms a preassembled constructional unit.

14. The input assembly in accordance with claim 1, wherein the operator control apparatus comprises a remote control apparatus.

15. The input assembly in accordance with claim 1, wherein the operator control apparatus comprises a radio remote control apparatus.

16. An operator control apparatus, comprising a splash-proof housing and at least one input assembly, each of the at least one input assembly comprising:

a pushbutton head adapted to be manually displaceable along a longitudinal axis, and a movable signal transmitter which is coupled to the pushbutton head via a coupling mechanism, at least one latch element having a latch head which has associated therewith at least one latch depression, the latch head entering the latch depression when the pushbutton head reaches a predetermined stroke position, a travel groove associated with the at least one latch element, the travel groove extending parallel to the longitudinal axis, wherein:

the latch head of the latch element enters the travel groove permanently, the at least one latch depression associated with the latch element is arranged in the travel groove, the latch head is of ball-shaped configuration and the travel groove has, relative to the longitudinal axis, a concave, circular arc shaped surface contour in a circumferential direction and, in an axial direction, an undulating surface contour comprising ridges and depressions which succeed each other in the axial direction and along which the latch head slides in line contact therewith when the pushbutton head is moved, and the signal transmitter of the at least one input assembly interacts with a sensor element which is arranged in the housing.

17. The operator control apparatus in accordance with claim 16, wherein:

the housing comprises at least one exterior recess which receives the at least one input assembly, and the at least one input assembly is adapted to be insertable into the recess in the form of a preassembled constructional unit and removable from the at least one exterior recess when required.

18. The operator control apparatus in accordance with claim 16, wherein the signal transmitter and the sensor element interact in a contactless manner.

19. The operator control apparatus in accordance with claim 18, wherein the signal transmitter is configured as a permanent magnet and the sensor element is sensitive to magnetic fields.

20. The operator control apparatus in accordance with claim 16, wherein the operator control apparatus comprises at least one connecting element which is adapted to be placed upon the at least one input assembly and to be releasably connected to the housing.

21. The operator control apparatus in accordance with claim 20, wherein the at least one connecting element is configured as a union ring which is screwably connectable to the housing.

22. The operator control apparatus in accordance with claim 17, wherein the at least one exterior recess of the housing has a support surface and the at least one input assembly further comprises a support part which is supported on the support surface.

23. The operator control apparatus in accordance with claim 16, wherein the operator control apparatus comprises a remote control apparatus.

* * * * *